US005529049A

United States Patent [19]

Antalosky

[11] Patent Number: 5,529,049

[45] Date of Patent: Jun. 25, 1996

[54] PIVOTALLY ADJUSTABLE ARROW REST

[76] Inventor: Richard L. Antalosky, 536 E. Pine St., Mahanoy City, Pa. 17948

[21] Appl. No.: 428,039

[22] Filed: Apr. 25, 1995

[51] Int. Cl.[6] ..... F41B 5/22; F41B 5/14

[52] U.S. Cl. ..... 124/44.5; 124/24.1; 124/41.1

[58] Field of Search ..... 124/24.1, 44.5, 124/41.1

[56] References Cited

U.S. PATENT DOCUMENTS

| | | | |
|---|---|---|---|
| 4,236,497 | 12/1980 | Troncoso, Jr. | 124/44.5 X |
| 4,542,731 | 9/1985 | Quartino | 124/24 |
| 4,759,337 | 7/1988 | Suski | 124/44.5 X |
| 4,890,596 | 1/1990 | Barlow | 124/44.5 |
| 4,899,716 | 2/1990 | Martin et al. | 124/44.5 |
| 5,031,601 | 7/1991 | Guunter | 124/44.5 |
| 5,052,364 | 10/1991 | Martin et al. | 124/44.5 |
| 5,070,855 | 12/1991 | Troncoso | 124/24.1 X |
| 5,095,884 | 3/1992 | Mertens | 124/44.5 |
| 5,103,797 | 4/1992 | Newbold | 124/44.5 |
| 5,137,006 | 8/1992 | Gallops | 124/44.5 |
| 5,251,606 | 10/1993 | Colvin | 124/24.1 X |
| 5,253,633 | 10/1993 | Sisko | 124/24.1 X |
| 5,460,152 | 10/1995 | Specht | 124/44.5 |
| 5,462,041 | 10/1995 | Solecki | 124/24.1 X |

*Primary Examiner*—Henry E. Raduazo
*Assistant Examiner*—Thomas A. Beach
*Attorney, Agent, or Firm*—Sanford J. Piltch

[57] ABSTRACT

An arrow rest assembly for use in archery comprises first and second supports each of which carries a pivotal plunger and retracting pin on which rests an arrow prior to its being launched from a bow. The supports are both mounted to a bracket each being separately slidingly and rotationally adjustable in the vertical plane relative to the bracket which is slidably laterally adjustable and adjustable front to back relative to the bow. Each of the pivotal plungers has first and second yielding and biasing means respectively allowing the plungers to deflect in both the horizontal and vertical planes in response to impingement by an arrow as it is being launched from the bow substantially eliminating deflection to the intended flight trajectory of the arrow.

4 Claims, 1 Drawing Sheet

PIVOTALLY ADJUSTABLE ARROW REST

FIELD OF THE INVENTION

The present invention relates to an arrow rest assembly for an archery bow and, more particularly, to an arrow rest assembly that does not disturb the intended flight of an arrow, even when the arrow impinges the arrow rest assembly.

BACKGROUND OF THE INVENTION

Arrow rest assemblies for archery bows have been utilized for some time. A variety of such rests are disclosed in U.S. Pat. Nos. 4,542,731, 5,052,364, 5,095,884, 5,103,797, and 5,137,006, all of which are incorporated herein by reference.

Arrow rest assemblies are typically attached to an archery bow for supporting an arrow before and during release thereof. Many arrow rest assemblies allow lateral adjustments so that the arrow rest assembly and its associated elements, may be aligned with the drawn bow string and to adapt to the aiming and shooting styles of different archers. Further, many arrow rest assemblies allow for angular and fore/aft adjustments, all relative to the archery bow. It is desired to make all of such adjustments for aiming and launching purposes separable so that the adjustment of one setting does not unnecessarily disturb the other possibly already adjusted settings.

When an arrow is launched from a bow (launching being more pronounced using modern bows of today) it is subjected to a sudden propulsive force, which accelerates the arrow, instantaneously, from a resting state to possibly several hundred feet per second. More often than not, this propulsive force is combined with a lateral or upward torque that is imparted to the arrow by the release of the bow string, causing the arrow to deviate from its desired flight path, especially in its launching phase. If this deviation is significant, the arrow may undesirably contact the arrow rest assembly which may also undesirably cause the arrow to deviate from its intended flight path and from the intended target. This defeats the intended purpose of the arrow, to hit the target at its aiming point. It is desired that an arrow rest assembly be provided that does not disturb the intended flight of the arrow even if the arrow impinges upon the arrow rest assembly during its launching phase.

Accordingly, it is a primary object of the present invention to provide an arrow rest assembly that substantially eliminates any disturbances to the intended flight path of an arrow, even if the arrow undesirably impinges the arrow rest assembly during its launch phase from the bow.

It is another object of the present invention to provide an arrow rest assembly that is connected to an archery bow so as to not only provide for non-disturbance of the flight path of the arrow, but to also allow the arrow rest assembly and all of its coacting components to be adjusted in both the vertical and horizontal directions with respect to the bow for achieving greater precision in aiming the arrow prior to its launching.

It is a still further object of the present invention to provide an arrow rest assembly that is connected to an archery bow so as to place the arrow rest assembly at one of a plurality of preselected positions for vernier aiming purposes so that the fine tuning for aiming purposes may be more easily accomplished.

Further objects and features of the present invention will become evident hereafter.

SUMMARY OF THE INVENTION

The present invention is directed to an arrow rest assembly for use in archery that does not disturb the intended flight path of an arrow, even if the arrow undesirably contacts the arrow rest assembly during the launch phase of the arrow.

The arrow rest assembly comprises a bracket, first and second supports, first and second plungers, first and second yielding and biasing arrangements, and first and second pivotal means. The first and second supports have means for connecting to the bracket and the first and second plungers each has a first yielding and biasing arrangement to deform in response to being impinged by an arrow from an at-rest position and to subsequently return each plunger to its at-rest position. The second yielding and biasing arrangement respectively connects each of the first and second plungers to the first and second supports. The second yielding and biasing arrangement allows its respective plunger to be displaced relative to its respective support in response to being impinged by the arrow and subsequently return its respective plunger to its non-displaced position relative to its respective support. The first and second pivotal means also respectively connects the first and second plungers to the first and second supports. Each of the first and second pivotal means is respectively arranged with each of the second yielding and biasing arrangement so that the respective plunger is pivotally displaced relative to its respective support in response to being impinged by an arrow and subsequently returned to its non-pivotal, non-displaced, at-rest position relative to its respective support.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DESCRIPTION OF THE INVENTION

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
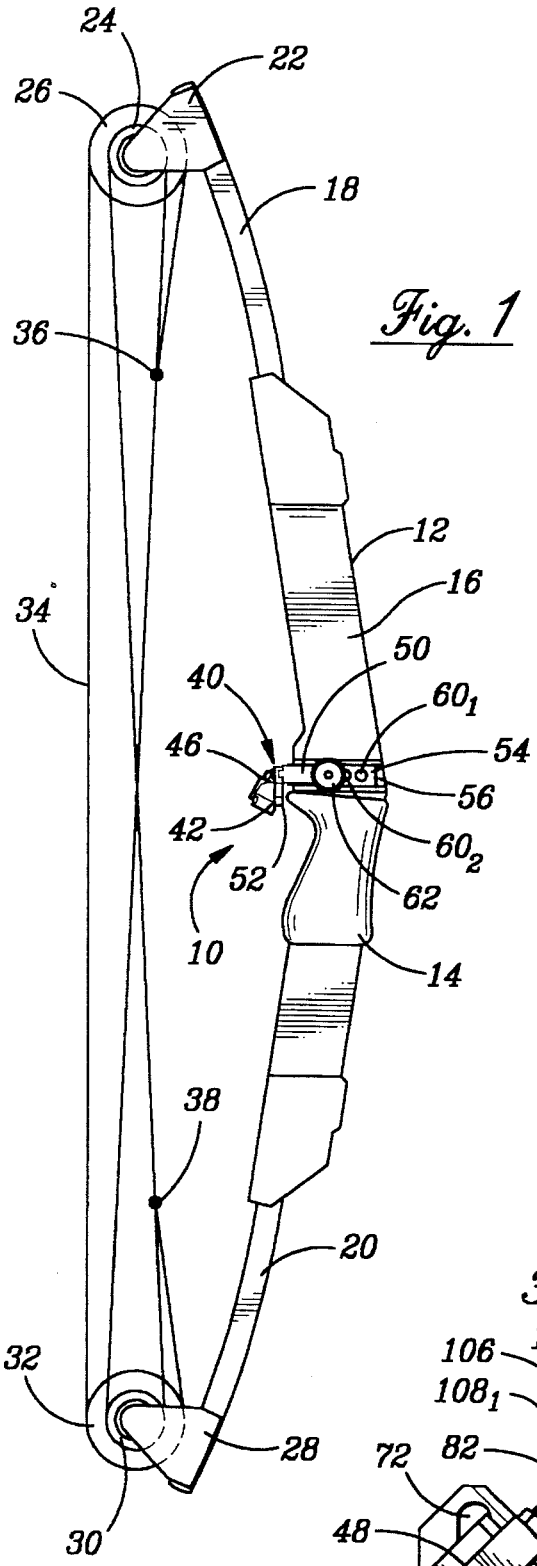
FIG. 1 is a side elevational view of the pivotally adjustable arrow rest assembly of the present invention attached to a compound archery bow.

Referring now to the drawings in detail, wherein like numerals refer to like parts or elements, there is shown in FIG. 1 a side elevational view of a pivotally adjustable arrow rest assembly 10 of the present invention attached to a compound archery bow 12. The compound bow 12 comprises a grip 14, a handle 16, an upper limb 18 and a lower limb 20. Although the bow 12 illustrated in FIG. 1 is a compound bow, the invention is not limited to combination with only a compound bow. The bow 12 may be of other types, e.g. long and recurved, which are known in the art. The upper limb 18 of the compound bow of FIG. 1 is coupled by a clamping device 22 to an arrangement of a first cam 24 and a first pulley 26. The lower limb 20 is coupled by a clamping device 28 to an arrangement of a second cam 30 and a second pulley 32. A bow string 34 surrounds and is carried by the cams 24 and 30 and by the pulleys 26 and 32. Button type pincers 36 and 38 are provided to adjust the tension in the bow string 34. As is known in the art, the cams 24 and 30, the pulleys 26 and 32, and the pincers 36 and 38 are arranged to adjust and provide for a spring pull force established by the bow string 34 so as to launch an arrow from the archery bow 12 at a relatively high acceleration.

Initially, upon the release of the bow string 34, a relatively high driving force is applied to the rear of the arrow. In theory, if the force is perfectly aligned with the axis of the arrow, with no off-axis horizontal or vertical forces induced by a less than desired release, the arrow will maintain a desired path during its initial launch phase which will continue during its flight phase to the desired target. As a practical matter, it is almost impossible, even for the most skilled archer, to apply all of the rearward launching force at the rear of the arrow and along the axis of the arrow. Invariably, both horizontal and vertical off-axis rearward forces are applied to the arrow, which forces cause the arrow to deviate from its intended path, especially during its launch phase. This deviation may cause the arrow to impinge the arrow rest assembly which, in turn, further disturbs the flight path of the arrow from its intended target, and thereby defeats the intended purpose of an otherwise accurate archery bow. The arrow rest assembly 10 of the present invention reduces, or even substantially eliminates, any undesirable contributions of the arrow rest assembly 10 to a deviation in the trajectory of the arrow's intended flight path.

The arrow rest assembly 10 is pivotally adjustable and comprises a bracket 40 and first and second supports 42 and 44 (only partially shown in FIG. 1, but fully illustrated in FIG. 2) each connected to the bracket 40. The arrow rest assembly 10 further comprises first and second plungers 46 and 48 (only partially shown in FIG. 1, but fully illustrated in FIG. 2) that are respectively interconnected to the first and second supports 42 and 44 as to be further described with reference to FIGS. 2, 3 and 4.

Figure 2:
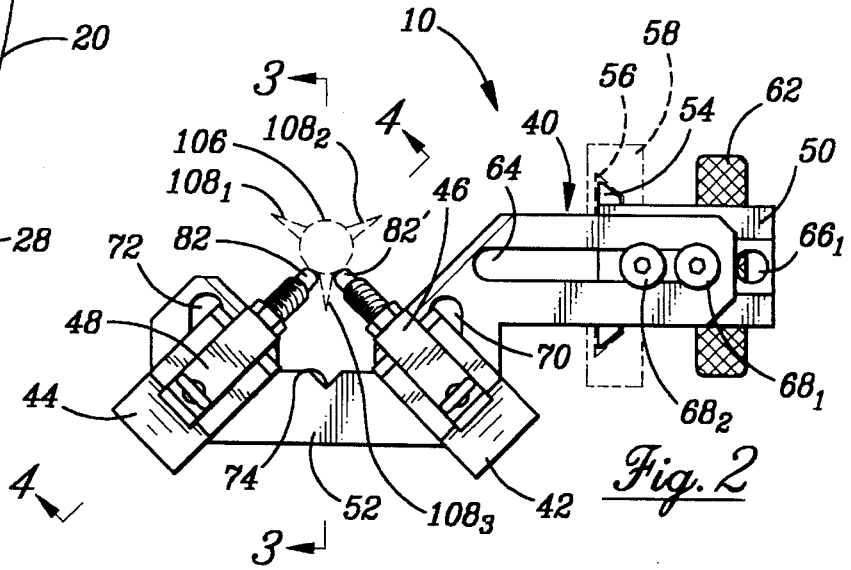
FIG. 2 is a forward looking view of a left-hand arrangement of the pivotally adjustable arrow rest assembly of the present invention.

With reference to FIGS. 1 and 2, bracket 40 has a mounting arm 50 and a lateral extension arm 52. A wedge-shaped member 54 of the mounting arm 50 is positioned in a dovetail shaped channel 56 so that the wedge-shaped member 54 is slidably adjustable in both the forward and rearward directions relative to the grip 14 of the bow 12. The dovetail shape of the channel 56 and the like shaped wedge of the member 54 is to prevent rotational motion of the mounting arm 50 outward from the vertical plane of the grip 14 and handle 16 of the bow 12. Thus, the cooperation of the wedge-shaped member 54 in the channel 56 comprises means for slidably attaching and adjusting the arrow rest assembly 10 to the bow 12 by means of an attachment member 58 into which the channel 56 is formed. The attachment member 58 may be a solid rectangular shaped piece either attached to the bow 12 by any conventional means or made part of the handle portion of the bow.

The wedge-shaped member 54 of the mounting arm 50 has a plurality of openings $\mathbf{60}_1$, $\mathbf{60}_2$ . . . $\mathbf{60}_n$ (not shown), preferably threaded, so that an adjustable knob 62, having a knurled surface for gripping purposes, may be inserted and selectably threaded into any of the openings $\mathbf{60}_1$ . . . $\mathbf{60}_n$ so as to provide a force against the back wall of the channel 56 in attachment member 58 to fixedly capture the wedge-shaped member 54 in position against the internal forewalls of the channel 56. The knob 62, cooperating with the apertures $\mathbf{60}_1$ . . . $\mathbf{60}_n$, permits the arrow rest assembly 10 to be slidably adjusted to a forward position (into the page as depicted in FIG. 1) or to a rearward position (out of the page as depicted in FIG. 1) relative to the location of the handle 16 of the bow 12. These forward and rearward (fore/aft) adjustments allow the arrow rest assembly 10 to be horizontally adjusted relatively to the handle 16 bow 12 for precision aiming of the arrow prior to its being launched.

The arrow rest assembly 10 of the present invention is also laterally adjusted relative to the handle 16 which is described with reference to FIG. 2, a forward looking elevational view of a left-hand arrangement of the arrow rest assembly 10 of the present invention. The lateral extension arm 52 of the bracket 40 is a left-hand arrangement, i.e., it extends to the left side (as depicted in FIG. 2) of the grip 14 of the bow 12, but the practice of this invention also contemplates a right-hand arrangement with the lateral extension arm 52 of the bracket 40 extends to the right of the grip 14 of the bow 12. The lateral extension arm 52 has first elongated opening 64, which is operatively oriented in the lateral or horizontal plane relative to the bow 12. The first elongated opening 64 is dimensioned to overlay a series of laterally spaced apart openings $\mathbf{66}_1$ . . . $\mathbf{66}_n$ in the mounting arm 50 to accept a plurality of attachment means $\mathbf{68}_1$, $\mathbf{68}_2$ to mount the lateral extension arm 52 to the mounting arm 50. The attachment means may be a nut and associated bolt, or any other attachment device which cooperates for tightening to hold the lateral extension arm 52 and mounting arm 50 in fixed position relative to each other. The placement of the attachment means $\mathbf{68}_1$ and $\mathbf{68}_2$ into the appropriate opening $\mathbf{66}_1$ . . . $\mathbf{66}_n$ of the mounting arm 50 allows the arrow rest assembly 10 to be placed in a predetermined position offset from the vertical plane of the handle 16. Once so positioned the lateral extension arm 52 may be slidably adjusted to the extent of the first elongated opening 64 to a desired fixed lateral position relative to the handle 16 of the bow 12 to further assist in the precision aiming of the arrow prior to its being launched.

The lateral extension arm 52 has second and third elongated openings 70 and 72 operatively oriented in a substantially vertical direction relative to the handle 16 of bow 12. The second and third elongated openings 70 and 72 are laterally spaced equal predetermined distances from a V-shaped notch or cutout 74 in the lateral extension arm 52. The second and third elongated openings 70 and 72 are so positioned to respectively receive the first and second supports 42 and 44. Each of the first and second supports 42, 44 are attached to the lateral extension arm 52 by passing a manually manipulated threaded fastening means 76 through each of the second and third elongated openings 70, 72 to hold the supports 42, 44 in the desired position. The desired or selected position is adjustable upwards and downwards by sliding the supports 42, 44 up and down within the elongated openings 70, 72 and also adjustable by rotating each support through an arc to a desired angular relationship to the vertical plane of the handle 16 of the bow 12.

The first and second supports 42, 44 are positioned to support the arrow shaft along their tips with a typical arc length between them of approximately 90°, thereby making the first and second supports 42, 44 substantially orthogonal to each other. As set forth above, the supports 42, 44 are slidably adjustable and rotationally adjustable in the vertical plane relative to the bow 12. This is to accommodate arrows having different diameter shafts with such adjustments to the positioning of the supports 42, 44 being described with reference to FIG. 3.

Figure 3:
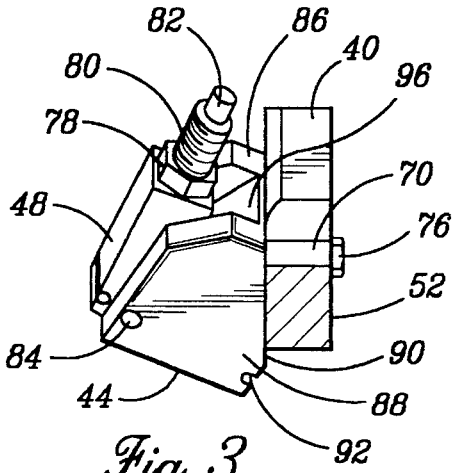
FIG. 3 is a view of the left-side arrow support components of the pivotally adjustable arrow rest assembly of the present invention, taken along Line 3—3 of FIG. 2.

For the sake of clarity, the description to be given with reference to FIG. 3 (and also FIG. 4) will be directed to the second support 44 (the left-hand support as shown in FIG. 2) and the second plunger 48 (also the left-hand plunger as shown in FIG. 2) having a keeping pin 80. However, it should be realized that the description of FIGS. 3 and 4 is equally applicable to the first support 42 and to the first plunger 46 with any of the described corresponding elements indicated by the prime (') designation.

As shown in FIG. 3, the second support 44 is held in position by a threaded fastening means 76 dimensioned to be inserted through the third elongated opening 72. The second support 44 is slidably adjustable within the extent of the opening 72, in both the vertical and rotational (angular) planes, and once its desired position (vertical placement and angular rotation) is achieved, the threadably engageable fastening means 76 is tightened holding the second support 44 in that fixed position. The adjustment of the second support 42 within the third elongated opening 72 adjusts the height or extension of the second plunger 48. The height of the second plunger 48 may also be adjusted by means of a threaded adjusting nut 78 mounted around a threaded guide cylinder 80 housing a pin 82 which defines the apex of the second plunger 48. The second plunger 48 is pivotally attached to the second support 44 by means of a pivot pin 82 to be further described hereinafter.

The second support 44 has sidewalls 86 and 88 dimensioned to restrict any lateral rotational movement, but not forward rotational movement of the second plunger 48. The second support 44 has a front wall 90 that has slots 92 cut into its face at the junctions with sidewalls 86, 88, into which slots as inserted a retaining pin 94 (not shown in FIG. 3 but shown in FIG. 4). The front wall 90 also has an inclined central region 96, which will be described below with reference to FIG. 4. As shown in FIG. 4, the inclined portion 96 allows the second plunger 48 to be tipped or rotated forward by about an angle δ of about 15°. More particularly, as shown in FIG. 4, the inclined portion 96 allows the plunger in its at-rest position, shown in solid, to be tipped forward within the range of approximately 30°, as indicated by the phantom line drawing 48a of the second plunger 48.

Figure 4:
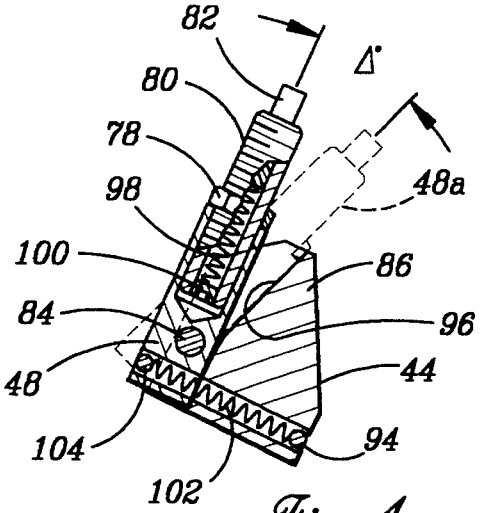
FIG. 4 is a view, partially in section, of the left-side arrow support components of the pivotally adjustable arrow rest of the present invention, taken along the Line 4—4 of FIG. 2.

As partially shown in FIG. 4, the second plunger 48 comprises an internal first yielding and biasing arrangement formed by a first spring means 98 that is held in place at one end by a button means 100 and at the other end impinges upon pin 82, all of which is housed within the guide cylinder 80. The second plunger 48 is maintained in its at-rest position by a second yielding and biasing arrangement formed by a second spring means 102. The spring means 102 is held in place at one end by the pin 94 and at the other end by the pin 104. The second plunger 48, more particularly the pin 82, is dimensioned so as to provide a resting surface for an arrow 106 which created supports are further described with reference to FIG. 2.

The plunger pins 82, 82' are comprised of a slippery polymer material having the characteristic of high wear resistance and self lubrication. The pins 82, 82' may be made from polymer compounds having the trade names TORLON or DELRIN, both manufactured by DuPont, or may be made from aluminum. The material selected for the plunger preferably prevents the plunger from scarring the arrow 100 (shown in phantom) or from increasing frictional forces as the shaft of the arrow passes over the pins 82, 82' as it is launched. The ability of the plungers 46, 48 to rotate forward about pivot pin 84 significantly lessens the interference of the arrow net 10 of the present invention from deflecting the arrow 106 in its launch or flight path. Additionally, the ability to tilt forward permits the fletching, at the rear most position of the arrow 106, comprising lightweight plastic members or shaped feather arrays, generally $\mathbf{108}_1$, $\mathbf{108}_2$, and $\mathbf{108}_3$, to ride over the pins 82, 82' without significantly affecting the arrow flight trajectory. The shaft of the arrow 106 may be composed of materials such as aluminum, wood or carbon composites, e.g. graphite. The materials from which the shaft is made produces the requirement for the arrow rest assembly 10 to be vertically and rotationally adjustable, as previously discussed. Adjustments to an arrow rest assembly to accommodate different arrow shaft diameters is known; however, the arrow rest assembly 10 of the present invention, in addition to its desired adjustment capabilities for arrow support and aiming purposes, has the unique and novel features of its non-interference with the flight characteristics and trajectory of the arrow 106, especially as it is being launched.

More particularly, and as may be envisioned with reference to FIGS. 2 and 4, if the arrow 106, is launched off-axis as most commonly occurs, any one of the fletching means $\mathbf{108}_1$, $\mathbf{108}_2$ or $\mathbf{108}_3$ may undesirably impinge either one of the first and second plungers 46 and 48. Upon such occurrence, and as shown in FIG. 4, the second plunger 48 will gently move itself out of the way from its at-rest position so that the impinging fletching means $\mathbf{108}_1$, $\mathbf{108}_2$ or $\mathbf{108}_3$ may easily pass across or over the plunger. More particularly, the pivotal second plunger 48, in response to being impinged by the fletching means $\mathbf{108}_1$, $\mathbf{108}_2$ or $\mathbf{108}_3$ caused by any off-axis launching force, will rotate or tilt forward, as shown in phantom representation 48*a* of FIG. 4. This tilting movement of the second plunger 48 from its at-rest position (shown in solid lines) is provided by the pivotal attachment of the second plunger 48 to the second support 44. The second plunger 48 will move itself forward by the operation of the second spring means 102 be returned to its at rest position due to the compression biasing action of the spring 102. Further, the plunger pin 82, in response to being impinged by any of the fletching means $\mathbf{108}_1$, $\mathbf{108}_2$ or $\mathbf{108}_3$ caused by any off-axis launching force, will gently move downward out of the way of the' impinging fletching means $\mathbf{108}_1$, $\mathbf{108}_2$ or $\mathbf{108}_3$. After the associated fletching devices $\mathbf{108}_1$, $\mathbf{108}_2$ and $\mathbf{108}_3$ passes by the second plunger 48 and pin 82, the second plunger pin 82 returns to its at-rest, non-deformed position by the expansion biasing action of the spring 98. The overall operation of the second plunger 48 and its associated first and second yielding and biasing arrangements 98 and 102 permit the arrow 106 to be accurately aimed and launched from the bow 12 without any significant impingement to the flight characteristics or deflection of the trajectory and find its way to its designated target.

It should now be appreciated that the practice of the present invention provides for an arrow rest assembly 10 that not only is adjustable to accommodate the desired aiming of the arrow prior to its launching, but also advantageously moves itself out of the launch path during the launching of the arrow 106.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. An arrow rest assembly for fixedly attaching to an archery bow comprising:

a. a bracket;

b. first and second supports having means for connecting to said bracket;

c. first and second plungers each having a first yielding and biasing arrangement to first deform the respective plunger from its at-rest position in response to being impinged by an arrow and subsequently return the respective plunger to its at-rest position;

d. second yielding and biasing arrangement for respectively connecting each of said first and second plungers to said first and second supports, said second yielding and biasing arrangement allowing its respective plunger to be displaced relative to its respective support in response to being impinged by said arrow and then subsequently returning its respective plunger to its non-displaced, at-rest position relative to its respective support; and e. first and second pivotal means for respectively connecting first and second plungers to said first and second supports, each of said first and second pivotal means being respectively arranged with each of said second yielding and biasing arrangement so that said respective plunger is pivotally displaced relative to its respective support in response to being impinged by said arrow and subsequently returned to its non-pivotal, non-displaced, at-rest, position relative to its respective support, whereby said arrow rest assembly is non-interfacing with the flight characteristics and trajectory of an arrow launched from said archery bow.

2. The arrow rest assembly according to claim 1, wherein said bracket further comprises a lateral arm including a first elongated opening operatively oriented in the horizontal plane relative to said archery bow for laterally adjusting said arrow rest, and second and third elongated openings operatively oriented in the vertical plane relative to said archery bow and located to respectively receive said first and second supports for vertically and rotationally adjusting said supports.

3. The arrow rest assembly according to claim 1 further comprising a mounting arm for demountably connecting said bracket to an attachment member affixed to the handle of said archery bow comprising a wedge-shaped member of the mounting arm for being slidably attachable to a member having a dovetail channel means on said handle of said archery bow being slidable forward and backward to the respective position of said arrow rest and fastening means for releasably connecting said wedge-shaped member of said mounting arm to said member on said archery bow.

4. The arrow rest assembly according to claim 1, wherein each of said plungers has a spring biased retractable tip for coming into contact with the shaft of said arrow for supporting said arrow prior to launching from said archery bow, said tip comprising a polymer having the characteristics of high wear resistance and self lubrication.

* * * * *